United States Patent [19]

Grearson et al.

[11] Patent Number: 4,457,115

[45] Date of Patent: Jul. 3, 1984

[54] BUILDING DECK STRUCTURE

[75] Inventors: Kenneth R. Grearson, Park Ridge; Robert Watson Jr., Woodstock, both of Ill.

[73] Assignee: Multuloc Corporation, Chicago, Ill.

[21] Appl. No.: 286,882

[22] Filed: Jul. 27, 1981

Related U.S. Application Data

[63] Continuation-in-part of Ser. No. 107,033, Dec. 26, 1979, Pat. No. 4,285,173.

[51] Int. Cl.[3] ..... E04C 2/26

[52] U.S. Cl. ..... 52/73; 52/250; 52/326; 52/336; 52/741

[58] Field of Search ..... 52/73, 250, 326, 336, 52/79.1, 602, 795, 741

[56] References Cited

U.S. PATENT DOCUMENTS

| | | | |
|---|---|---|---|
| 793,358 | 6/1905 | Doyle | 52/814 |
| 1,995,496 | 3/1935 | Burgess | 52/336 |
| 2,692,033 | 10/1954 | Jaynes | 52/73 |
| 3,392,499 | 7/1968 | McManus | 52/336 |

*Primary Examiner*—John E. Murtagh

*Attorney, Agent, or Firm*—Thomas W. Speckman

[57] ABSTRACT

A poured concrete deck structure which extends to the external building line or to a designated line of an internal opening of a building has a form deck which is supported by metal structural girders, including edge girders which are spaced from the building line or designated line, and an edge construction which retains the concrete according the building specifications. The edge construction is improved by terminating the form deck at the edge girders, providing a plurality of spaced support means secured to the top of the edge girders and extending towards the building line or designated line and providing a plurality of adjacent pans for retaining the poured concrete. The pans are supported by at least two supports, and are in communication with an edge girder. The pans may be secured to the edge girder, to the support means, or to both, after proper alignment with the building line or designated line. The edge construction may be installed without sub-deck support or scaffolding beneath the deck during construction.

51 Claims, 12 Drawing Figures

BUILDING DECK STRUCTURE

CROSS REFERENCE TO RELATED APPLICATION

This application is a continuation-in-part of our related co-pending application Ser. No. 107,033, filed Dec. 26, 1979, and allowed Feb. 27, 1981 now U.S. Pat. No. 4,285,173. That allowed application is incorporated herein by reference in its entirety.

BACKGROUND OF THE INVENTION

1. Field of the Invention

This invention relates to poured concrete building deck structures which may perform the function of floors or roof decks on steel frame buildings. The concrete for the deck structure is poured over a corrugated sheet metal form deck which is supported by steel frame girder and spandrel members. The edge of the deck may extend beyond the girder which is closest to the building line or a designated line of an opening inside the building. The improved building deck described in our related application provides strength to the metal form deck at the sides which are normally parallel to the corrugations of the metal form deck and provides an adjustable edge bracket around four sides of the deck structure for easy and precise alignment with the desired building line. If the edge extends a substantial distance from the nearest structural girder, however, scaffolds or other sub-deck assembly supports may be required to support the edge construction during and after alignment. This invention relates to improved edge constructions which do not require sub-deck supports and may be easily and safely aligned with the building line or designated line.

2. Description of the Prior Art

In present day steel frame building construction, particularly of multi-story residential, office and industrial buildings, the floor and roof decks may be constructed by laying a deeply corrugated metal form deck over the horizontal steel frame girder and spandrel members and surrounding the edges of the deck with a vertical edge form. Concrete is poured on top of the metal form deck, usually with reinforcing bars or mesh embedded therein to provide structural strength. The concrete construction loads are restrained by the edge form.

Modern building designs often specify that the edge of the deck must extend beyond the girders and columns which are adjacent the building line or a designated line of an opening inside the building. Taller buildings generally have larger columns, and extend further from the edge girders and columns. Several problems may be encountered in the construction of such decks. One problem is that if the corrugated metal form deck extends over and beyond the horizontal girder members, the edges of the deck parallel to the corrugations of the metal create a dangerous working situation and require expensive sub-deck structural bracing to support the edge construction of the metal form deck. The same problem exists at openings in the floor and roof decks in the interior of the building, such as elevator shafts, stairways, atriums and the like.

Another problem which arises along the sides of the building parallel to the corrugations in the corrugated metal form deck is alignment of the edge of the deck with the desired building line, which cannot usually be measured from the girders beneath the deck since the girders are frequently not in the desired alignment. The same building line alignment problem exists at the sides of the building which are perpendicular to the corrugations of the metal form deck in that the ends of the metal pan must either be tediously aligned or cut with a torch to the exact building line requirement after proper dimensions are ascertained.

Attempts have been made to solve these problems by securing the deck structure to the girder which is closest to the building line or opening inside the building and using L-shaped pans secured to the edge girder to provide desired stiffness to the edge of the deck and to provide an edge form for the concrete, as seen in U.S. Pat. No. 3,024,573. However, it is difficult to install the L-shaped pans precisely to form the desired building line because they are not supported during alignment. Also, the pans must be properly aligned with the desired building line upon installation, and may not be installed and later aligned. Thus, if the building line has not been determined before installation, the installation crew will be delayed, which is expensive. Further, if the pans extend substantially beyond the edge girder, they must be installed from scaffolding from the floor beneath or supported by a sub-deck assembly. The weight of the concrete may be significant, requiring substantial support. The scaffolding and/or sub-deck supports are heavy and expensive, and at the edge of the building, create a particularly dangerous working condition. Also the expense incurred in merely transporting the scaffolding and/or sub-deck supports throughout the building during construction is substantial. These difficulties in construction are more acute as buildings are designed with more and more floors, as edges extend further and further from the nearest adjacent girder, and as the costs of construction increase.

Accordingly, an object of this invention is to provide a metal form deck structure having an edge construction which is supported from the top of the deck without the necessity of erection of scaffolding or other sub-deck support apparatus at the edge of the deck blow to complete the form deck structure.

Another object is to provide a metal form deck structure which is supported while it is aligned with the desired building line or opening.

Yet another object is to provide a metal form deck structure which has a modular edge construction that may be constructed at oblique angles to adjacent modules and to the girder to which the modules are secured.

Still another object is to provide a metal form deck structure which has reduced concrete at the edges of the structure and provides lateral stiffness along the modules of the edge construction.

It is another object of this invention to provide a poured concrete building deck structure having a protective and readily removable toe board around the edges and all openings, and to provide for easy installation and removal of a perimeter rail to protect workers during construction.

It is a still further object of this invention to provide a modular edge construction having pieces which may be easily stacked for storage and transportation.

SUMMARY OF THE INVENTION

This invention provides a poured concrete deck structure which extends to the external building line or to a designated line of an internal opening of a building. The deck structure has a form deck which is supported by metal structural girders, including edge girders which are spaced from the building line or designated line. The edge construction of the deck is improved by terminating the form deck at the edge girders, providing a plurality of spaced support means secured to the top of the edge girders and extending towards the building line or designated line, and providing a plurality of adjacent pans for retaining the poured concrete. The pans are supported by at least two supports, and are in communication with an edge girder. The pans may be secured to the edge girder, to the support means, or to both, after proper alignment with the building line or designated line.

BRIEF DESCRIPTION OF THE DRAWINGS

These and other objects, advantages and features of this invention will be apparent from the description by reference to the drawings wherein preferred embodiments are shown as follows.

DESCRIPTION OF THE PREFERRED EMBODIMENTS

Many modern buildings are constructed by assembling a metal frame having horizontal girders at each floor, separated by vertical columns. The floor and roof decks may be concrete poured on top of a metal deck structure which is supported by the girders. The deck structure extends to the external building line or to a designated line of an internal opening such as an elevator shaft, hallway, stairway or atrium, or is spaced from the building line or designated line. Wall structures may be mounted on the deck structure to enclose the building.

Figure 10:
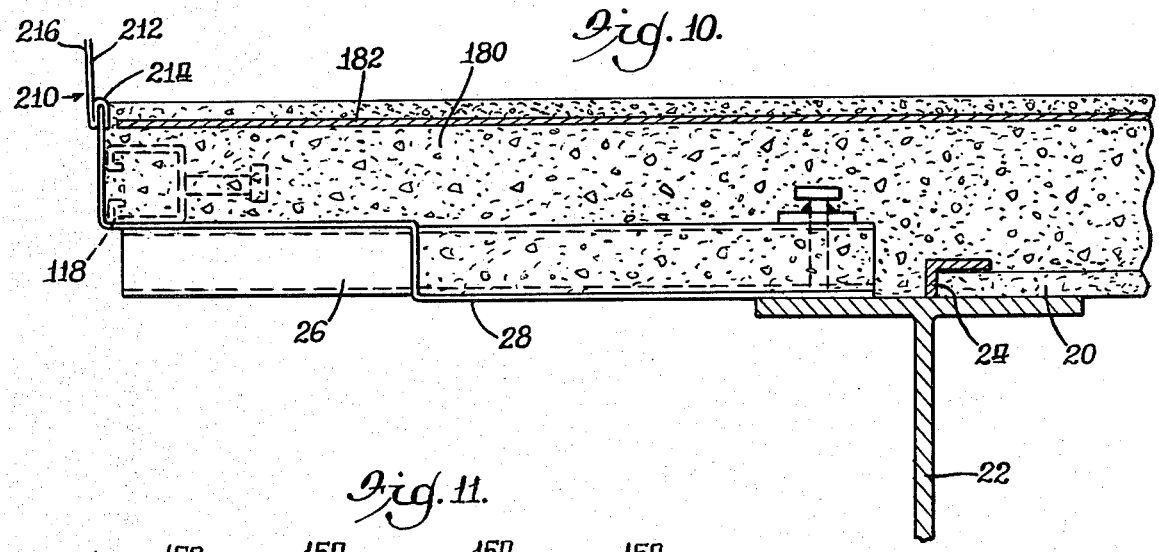
FIG. 10 is a sectional view taken along lines 10—10 in FIG. 9 showing the edge construction of FIG. 9 after concrete is poured.

The building line or designated line may extend beyond the metal frame by a predetermined distance. In such buildings, the deck structure includes a metal form deck and an edge construction which retains the concrete while it cures. The form deck may be a corrugated form deck which is supported by the girders, or any other suitable deck. When using the edge construction of this invention, the form deck 20 terminates at the edge girders 22, as seen in FIG. 10. A closure 24 may be secured to the end of the form deck 20 to cover exposed corrugations. If the closure 24 were not used, concrete might drip through exposed corrugations.

Figure 2:
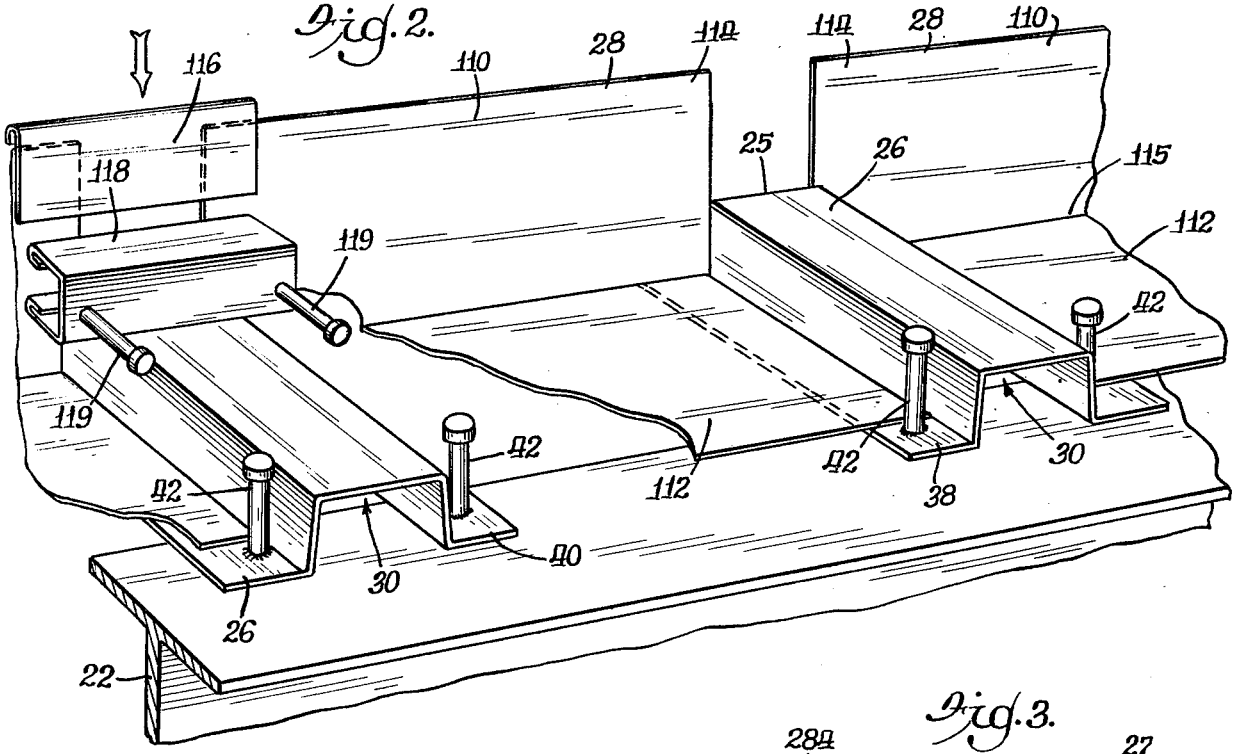
FIG. 2 is a perspective view of an alternate embodiment of the edge construction of FIG. 1.

A plurality of spaced support means 26 are provided around the edge of the building as well as the inner edge of internal openings in the building, as seen in FIG. 2. The spaced support means 26 are secured to the top of the edge girders 22, and extend towards the building line, or a designated line on an inner opening. The outer ends 25 of the support means 26 are generally spaced from the building line or designated line. A plurality of adjacent pans 28 having a horizontal sheet 112 and a vertical sheet 114 of sufficient height to retain poured concrete to a desired depth are supported by at least two of the support means 26 and are in communication with and secured against movement with respect to one of the edge girders 22. The pans 28 extend toward the building line or designated line, substantially filling the space between the edge girders and a desired distance from or at the building line or designated line and may be spaced from the line or extend to the line. The pans 28 will be spaced from the line if wall modules are later attached to the pans which extend to the building line or designated line. The pans may be secured to the support means 26 or the edge girder 22. If preferred, the pans 28 may be secured to both the support means 26 and edge girder 22.

Figure 1:
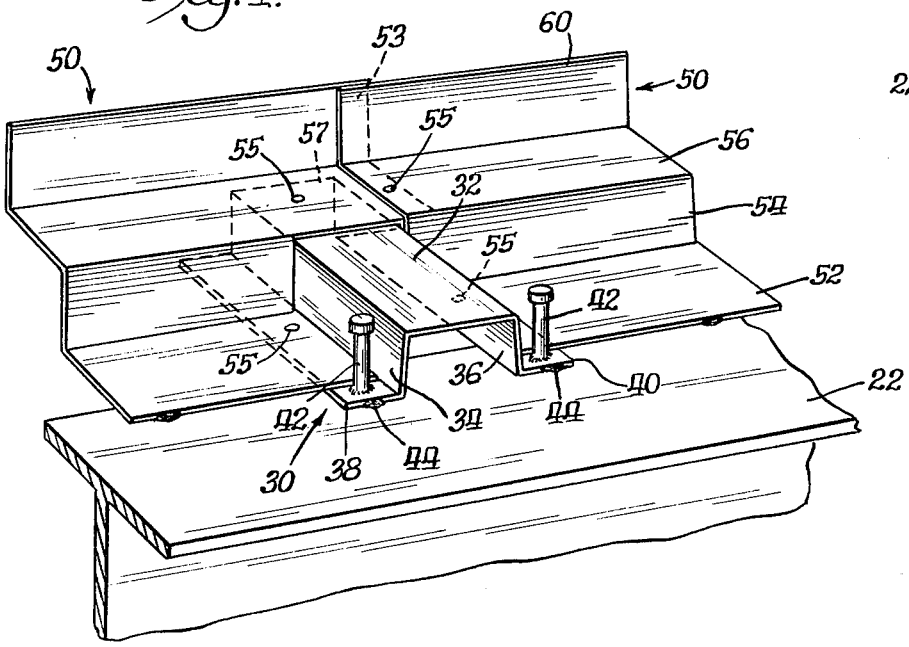
FIG. 1 is a perspective view of one embodiment of the edge construction of this invention including support means for the edge construction.

FIG. 1 illustrates one embodiment of an edge construction of this invention. The support means include a plurality of spaced supports 30 having a substantially horizontal surface 32 which is spaced upwardly from the edge girder 22 by a first vertical side 34 and a second vertical side 36. A first substantially horizontal flange 38 extends outwardly from first vertical side 34 adjacent the girder 22, and a second substantially horizontal flange 40 extends outwardly from the second vertical side 36 adjacent the girder 22. First and second vertical sides 34, 36 may be vertical, if desired, or may be at slightly oblique angles to each other so that the supports 30 may be easily stacked on top of each other for transportation and storage. The supports 30 are secured to girder 22 by any suitable means, such as studs 42 or welds 44. The studs 42 may be installed with a gun designed for that purpose, which welds the studs 42 and the support 30 to the girder 22. When concrete is poured, structural loads placed on the supports 30 are transferred through the studs 42 of welds 40 to the edge girder 22.

The edge construction of FIG. 1 also includes a plurality of pans 50 which are supported by at least two of the supports 30. Each pan 50 includes a first substantially horizontal portion 52 which rests on and extends laterally between the second horizontal flange 40 of one support 30 and the first horizontal flange 38 of an adjacent support 30. First horizontal portion 52 extends from the edge girder 22 toward the building line or designated line.

A first substantially vertical portion 54 extends upwardly from the outer edge of first horizontal portion 52 a distance to the horizontal surface 32 of support 30 and extends laterally along the length of the first horizontal portion 52.

A second substantially horizontal portion 56 extends from the first vertical portion 54. Second horizontal portion 56 extends laterally from over the second horizontal flange 40 of the first support 30 to a point 58 which is over or beyond the second horizontal flange 40 of the adjacent support 30. The second horizontal portion 56 is placed beneath the second horizontal portion of an adjacent pan. Second horizontal portion 56 extends beyond the ends 57 of supports 30.

A substantially vertical edge 60 extending laterally along the length of second horizontal portion 56 extends from the second horizontal portion 56 a vertical distance which is sufficient to retain poured concrete at the desired level.

The pans 50 may be formed from a single sheet of metal, or may be fabricated from several sheets, and may be easily stacked for storage and transportation.

The pans 50 are preferably secured against movement with respect to the edge girder 22 by self-tapping screws 55, or any other suitable means. It is suggested that the first horizontal portion 52 be secured to the flanges 38, 40, and that the second horizontal portion 56 be secured to horizontal surfaces 32 and the overlapping portion 53 of the adjacent second horizontal portion 56. This configuration holds the pans against wind forces and the like. Other configurations could also be used, if desired, and the pans could be secured to the edge girder 22, or the girder 22 and supports 30.

The edge construction of FIG. 1 may be installed on the top of the girders by workers on the form deck and girders by securing the supports 30 to the girder 22, placing the pans 50 between the supports 30, aligning the pans 50 with the building line or designated line, as required by the building specifications, and securing the pans 50 to the girder 22, the supports 30, or both. No sub-deck supports or sub-deck work are required. The first horizontal portions 52 of the pans 50 are supported by the first and second flanges 38, 40 of the supports 30. The second horizontal portions 56 of pans 50 are supported on one end by the horizontal surface 32 of supports 30, and on the other end by the second horizontal portion 56 of the adjacent pan, which extends over the horizontal surface 32 and second flange 40 of the support. Thus, the entire horizontal surface area of the pans are supported to retain concrete. Also, first vertical portion 54 provides lateral support for the pans 50.

The supports 30 may be installed before the building line or designated line is determined by the supervisory construction personnel, because the supports do not extend to the building line or designated line. Also, the pans 50 may be put into place without being secured before the line is determined. In this manner, assembly of the edge construction is not delayed if the supervisory personnel have not determined where the line is located. When the line is defined, the pans 50 may be properly aligned with respect to the line, and secured.

Figure 4:
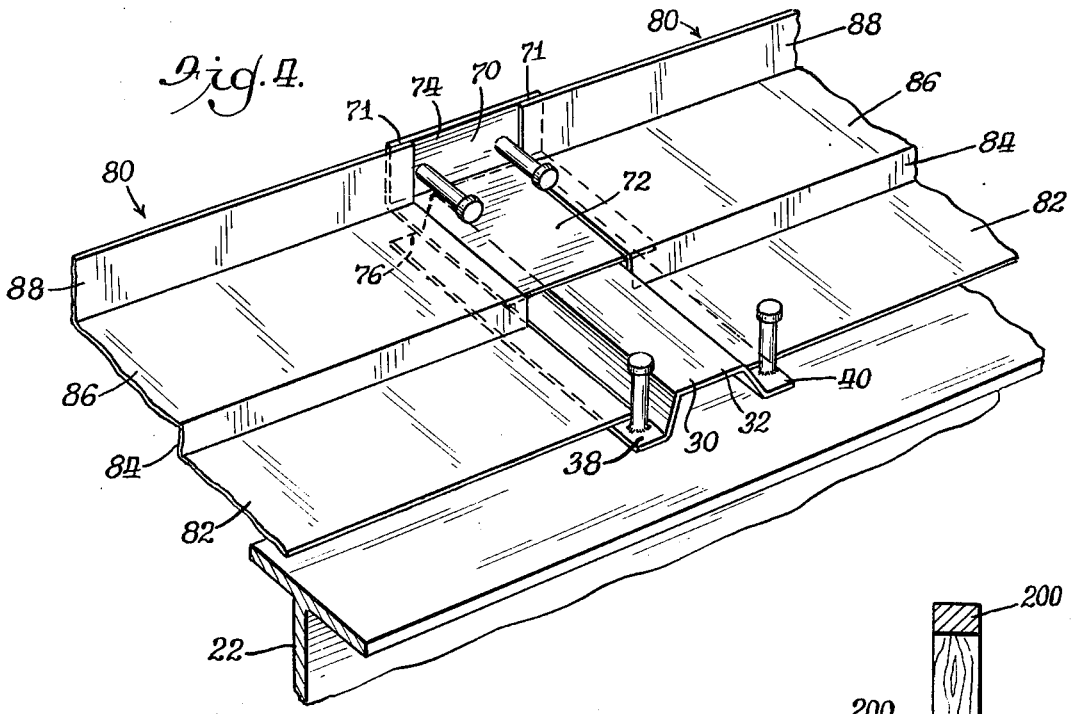
FIG. 4 is a perspective view of another alternate embodiment of the edge construction of FIG. 1.

The edge construction of FIG. 4 includes supports 30 as shown in FIG. 1, and a filler angle 70 secured to the support 30 by sheet metal screws or any other suitable means. Filler angle 70 includes a horizontal aspect 72 secured to the horizontal surface 32 of supports 30, and an upwardly extending aspect 74 which is at or beyond the end 76 of support 30. Upwardly extending aspect 74 is disposed toward the building line or designated line. The filler angle 70 extends laterally over the horizontal flanges 38, 40 of supports 30.

The pans 80 in FIG. 4 include a first substantially horizontal section 82 which rests on and extends laterally between the second horizontal flange 40 of a first support and the first horizontal flange 38 of an adjacent support. First horizontal section 82 is secured against movement with respect to the edge girder 22 by securement to either the girder, the flanges 38, 40, or any combination thereof. Securement may be made by self-tapping screws, welds or the like. The first horizontal section 82 extends from the girder 22 towards one of the building lines or designated lines. A first substantially vertical section 84 extends upwardly from the outer edge of first horizontal section 82 a distance to the horizontal surfaces 32 of support 30, and extends laterally along the length of first horizontal portion 82. A second substantially horizontal section 86 extends from the first vertical section 84 laterally along the length of the first horizontal section 82 and rests on a portion 71 of filler angle 70. A substantially vertical edge 88 extends laterally along the length of the second horizontal section 86 and extends upwardly from the second horizontal section 86 a vertical distance adjacent the upwardly extending aspect 74 of filler angle 70. The vertical distance is sufficient to retain poured concrete.

Installation of the supports 30 and pans 80 of the system is similar to that of FIG. 1. The filler angles 70 may be secured to the supports 30 before or after the supports 30 are secured to the girder 22. If secured before securement of the supports 30, the filler angles 70 must be properly aligned with the building line or designated line when the supports are secured. First horizontal section 82 is supported by flanges 38, 40, and second horizontal section 86 is supported by portions 71 of filler angle 70.

Figure 7:
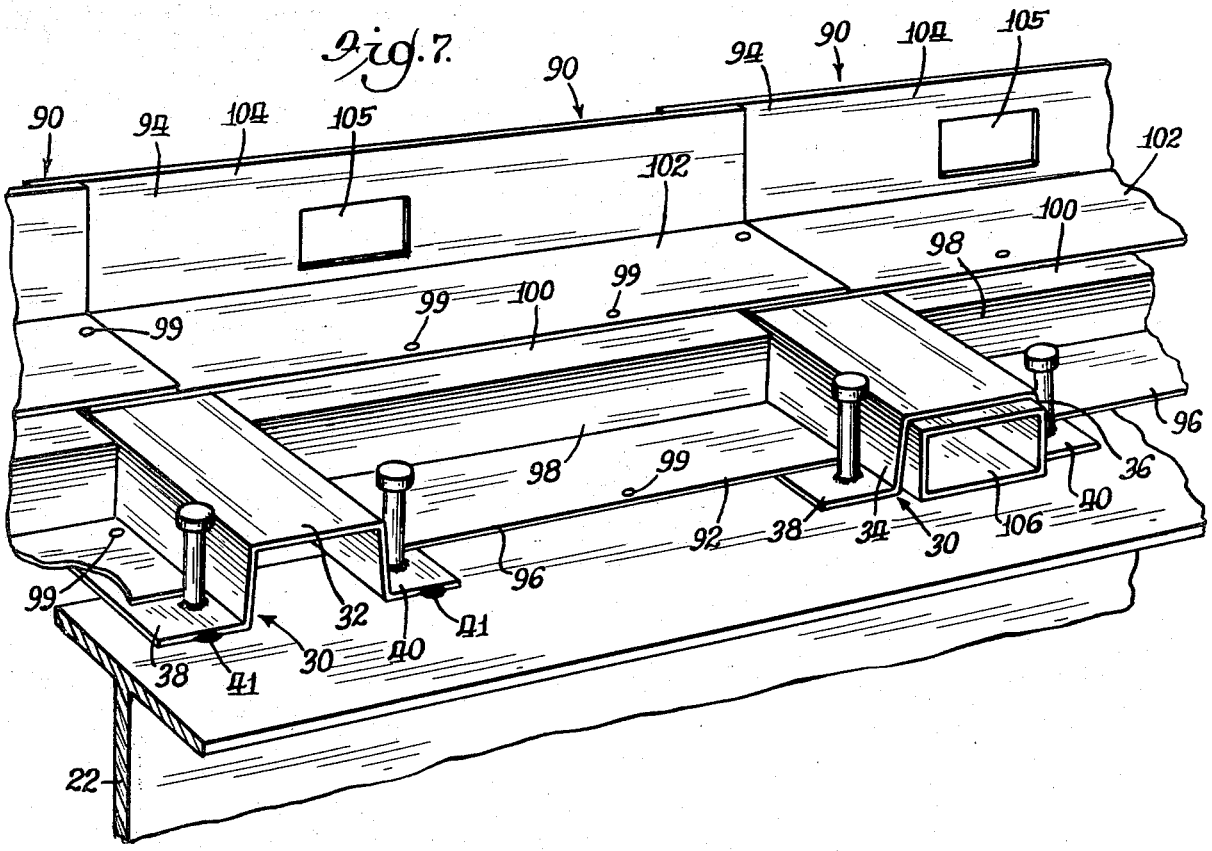
FIG. 7 is a perspective view of still another alternate embodiment of the edge construction of FIG. 1.

An alternate embodiment of an edge construction of this invention is shown in FIG. 7. The pans 90 include a flange pan 92 and a surface pan 94. Flange pan 92 includes a first substantially horizontal part 96 which rests on and extends laterally between the second horizontal flange 40 of a first support 30, and the first horizontal flange 38 of an adjacent support 30. First horizontal part 96 is secured against movement with respect to and extends from the edge girder 22 towards the building line or designated line.

A first substantially vertical part 98 extends upwardly from the outer edge of first horizontal part 96 a distance to the horizontal surface 32 of the supports 30 and extends laterally along the length of first horizontal part 98.

A substantially horizontal overlap part 100 extends from first vertical part 98 towards the building line or designated line, and extends laterally along the length of first vertical part 98.

Surface pan 94 includes a substantially horizontal part 102 which extends laterally between horizontal surfaces 32 of the first support 30 and adjacent support 30. Horizontal part 102 overlaps part 100 of the flange pan 92, and extends toward the building line or designated line.

Substantially vertical part 104 of surface pan 94 extends laterally along the length of horizontal part 102 and extends upwardly from horizontal part 102 a vertical distance which is sufficient to retain the poured concrete at the desired level. The horizontal parts 102 and vertical parts 104 of adjacent surface pans 94 may overlap if desired, as seen in FIG. 7. Also, a tubular support 106 may be provided between the first and second vertical sides 34, 36 of supports 30 for added support.

The supports 30 of FIG. 7 may be installed as previously described, and the flange pans 92 may be installed and secured to either girder 22, supports 30, or both, by any suitable means, including welds or screws 99. Surface pans 94 may be installed and secured to the supports 30, flange pan 92, or both, by any suitable means, such as welds or screws 99, after the building line or designated line has been defined.

The edge construction shown in FIG. 2 also includes supports 30 as shown in FIG. 1. The pans 110 in FIG. 2 include a first substantially horizontal sheet 112 resting on and extending laterally between the second horizontal flange 40 of a first support 30, and the first horizontal flange 38 of an adjacent support 30. First horizontal sheet 112 communicates with and is secured against movement with respect to the edge girder 22, and extends toward the building line or a designated line.

Substantially vertical sheet 114 extends upwardly from the outer edge 115 of horizontal sheet 112 a distance which is sufficient to retain poured concrete, and extends laterally along the length of the horizontal sheet 112. A substantially vertical joining sheet 116 extends over the support 30 between the vertical sheets 114 of adjacent pans 110. In this embodiment, the ends of the supports 30 and the vertical sheets 114 are generally at or a predetermined distance from the building line or designated line when they are installed.

Figure 8:
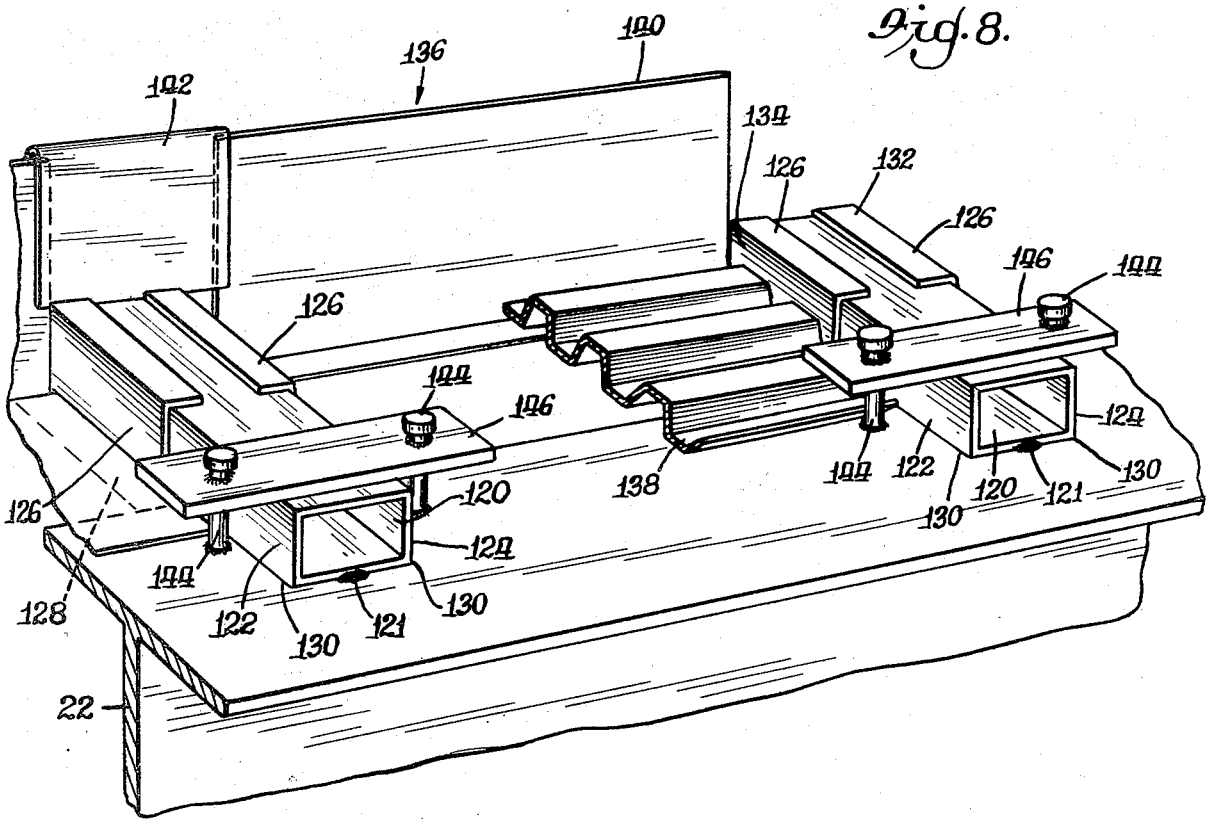
FIG. 8 is a perspective view of yet another alternate embodiment of the edge construction of FIG. 1.

The deck construction shown in FIG. 8 includes a plurality of tubular support members 120 which have two opposing substantially vertical sides 122 and 124. A holding member 126 having flanges 128 extending outwardly from the bottom 130 of each vertical side 122, 124 of the support members 120 is secured to the support members 120. The holding members 126 may be Z-shaped, and have a horizontal member 132 along the top of the support members 120, a vertical member 134 extending from the horizontal member 132 along the vertical side 122 or vertical side 124, and a flange member 128 extending from vertical member 134 away from the support member 120 adjacent the girder 22. The holding members 126 extend generally from the girder 22 towards the building line or designated line.

The pans 136 shown in FIG. 8 include a substantially horizontal ledge 138 which extends laterally between the flange member 128 of adjacent holding members 126, and extends from the edge girder 22 towards the building line or designated line. Ledge 138 may be corrugated material as shown in FIG. 8, or may take any other suitable shape. Outer edge member 140 extends laterally between the flange members 128 adjacent supports 120. Outer edge member 140 extends substantially horizontally from the ledge 138 towards the building line or designated line, and extends substantially vertically a distance which is sufficient to retain the poured concrete at the desired level.

A plurality of substantially vertical joining members 142 are secured over the supports 120 and extend laterally between the vertical extensions of adjacent outer edge members 140.

Figure 9:
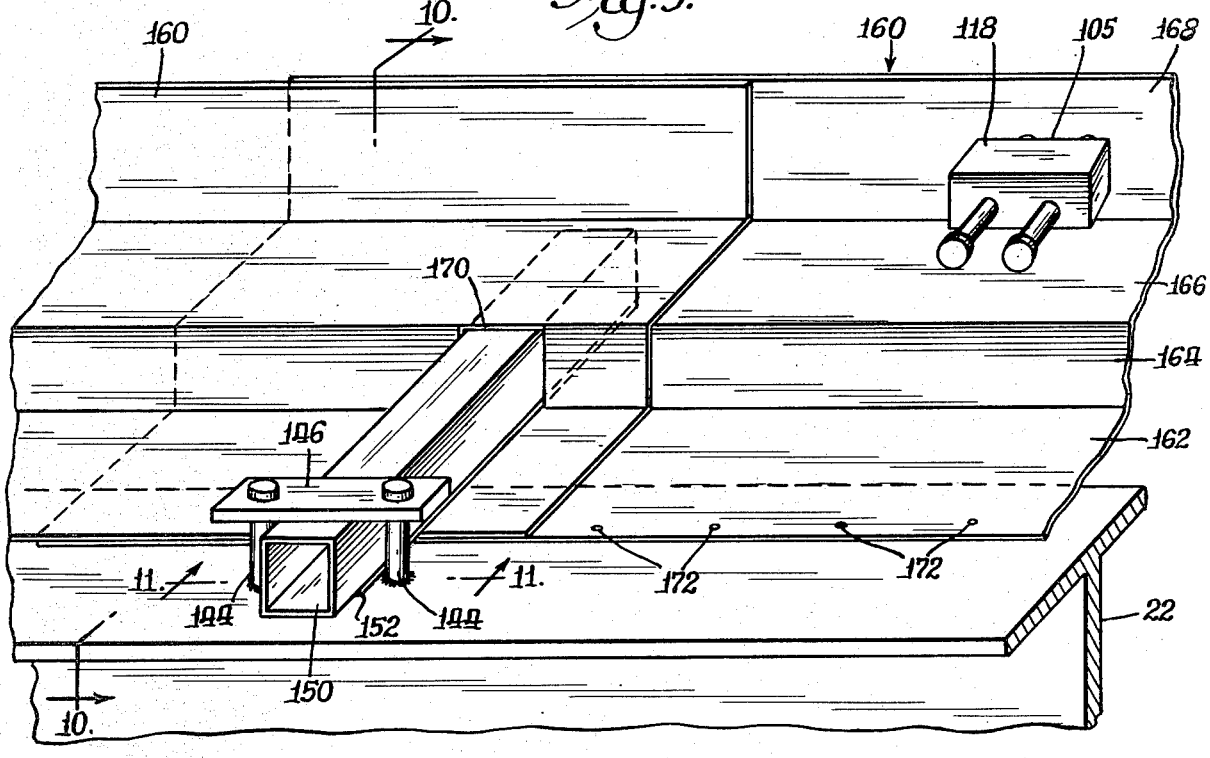
FIG. 9 is a perspective view of still another alternate embodiment of the edge construction of FIG. 1.
Figure 11:
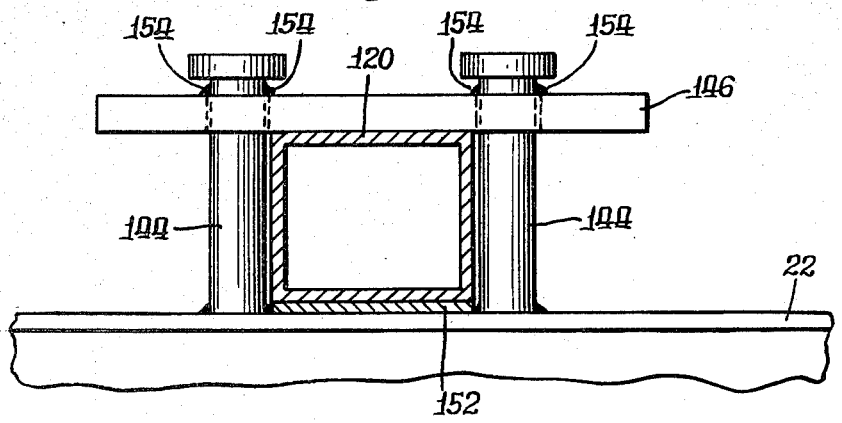
FIG. 11 is a sectional view taken along lines 11—11 in FIG. 9 showing a support secured to an edge spandrel.

The means of securing the supports 120 in FIG. 8 and 150 in FIG. 9 are shown in detail in FIG. 11. A stud 144 is welded to the edge girder 22 on each side of the supports 120. A bridge plate 146 secured to the studs 144 extends over the supports 120, securing them in place. The supports 150 may also be secured by welds 121, if desired.

Bridge plate 146 and studs 144 may be installed before the support 120 by placing the bridge plate on the girder 22 according to specifications and welding the studs 144 to the girder 22 through orifices in bridge plate 146. A removable mica wafer or other heat insulating material may be required between the girder 22 and the bridge plate 146 during welding to prevent the bridge plate 146 from being welded to the girder 22. The support 120 may be inserted beneath the bridge plate 146 after the studs 144 are welded to the girder 22 by lifting the bridge plate 146 and inserting the support 120 beneath it.

One or more shims 152 may be provided between the support 140 and the girder 22 for adjusting the angle of the support 120 with respect to a horizontal plane. When the support 120 is properly aligned with respect to the girder 22, the bridge plate may be pressed firmly against the support 120 and welded in place to the studs 144 by welds 154. In this manner, structural loads placed on the supports 120 are transferred through the bridge plate 146 and studs 144 to the edge girder 22. After the supports 120 are secured in place, pans 136 may be installed according to specifications by welds or screws. The vertical extensions of outer edge members 140 do not extend beyond the supports 120.

The edge construction shown in FIG. 9 includes supports 150 which are smaller to the supports 120 in FIGS. 8 and 11. The supports 150 may be round, rectangular or any other suitable shape.

The pans 160 in FIG. 9 include a first substantially horizontal component 162 which communicates with adjacent pans 160 and extends from the edge girder 22 towards the building line or designated line. A first substantially vertical component 164 extends upwardly from the first horizontal component 162, and extends laterally along the length of first horizontal component 162. Second substantially horizontal component 166 extends from the first vertical component 164 toward the building line or designated line to a second substantially vertical component 168, and extends laterally along the length of the first horizontal component 162. Second vertical component 168 extends from the second horizontal component 166 a vertical distance which is sufficient to retain the poured concrete at the required level.

At least two orifices 170 are provided in the first vertical component 164 of pans 160, through which the supports 150 may be inserted. The supports 150 extend from the girder 22 over first horizontal component 162, through an orifice 170, and beneath second horizontal component 166. In this manner, the entire pan 160 is supported by the supports 150. The pans 160 may overlap, as in FIG. 9, using a common support 150, or may be butted against each other using separate supports 150 for each pan 160.

The edge construction configuration of FIG. 9 may be installed by inserting the orifices 170 in pans 160 over supports 150, aligning the pans 160 according to specifications, and welding or screwing the pans 160 to girder 22 by welds or screws 172, to the supports 150, or to both the girder 22 and the supports 150.

Any of the edge constructions just described may be used to form a completed deck structure by pouring concrete 180 over the form deck 20 in FIG. 10, the girder 22, the support means 26 and the pans 28. Reinforcing bars 182 are used in the concrete for structural purposes. The edge constructions of FIGS. 1, 4, 5, 7, 9 and 10 require reduced concrete at the lower edges of the structure, which reduces costs and the weight of the deck structure at the outer edges.

Means are provided for mounting wall structures to the pans or support means of the edge construction of the deck. Mounting means 118 in FIG. 2 may extend between adjacent pans 28 over the supports 30 and beneath the joining sheet 116. The mounting means 118 includes anchors 119, which secure the mounting means in the poured concrete, as seen in FIG. 10, and may be welded to the support 30 in FIG. 2, the pans 28 or the joining sheet 116, as needed.

Mounting means 118 may be mounted in orifices 105 in FIG. 7, as shown in FIGS. 9 and 10. Also, other devices such as weld plate 184 in FIG. 6 may be secured to the pans 28 so that wall modules or wall curtains may be secured thereto by welding or other means. Anchors 185 may be provided on weld plate 184, as well.

The mounting means 118 could also be secured to the underside of exposed portions of the support means 26, if desired.

The pans and the mounting means may be fabricated for the mounting of various modular curtain wall structures and the like In many applications, most of the curtain walls are the same size, so the pans are identical and may include mounting means which are located in the same place on each pan. For example, 30 foot modules may be installed on a series of 5 foot pans, and 2½ foot modules may also be installed on 5 foot pans. Thus, the edge constructions of this invention are easily adaptable to a variety of building designs.

Safety regulations in the construction industry require that workers be protected from falling off the deck structure, and that objects be prevented from slipping off the deck structure during construction. This invention provides apparatus which may be added to the edge constructions of this invention which protect the workers during construction. Additional apparatus prevents smaller objects from falling off the deck structure.

Figure 5:
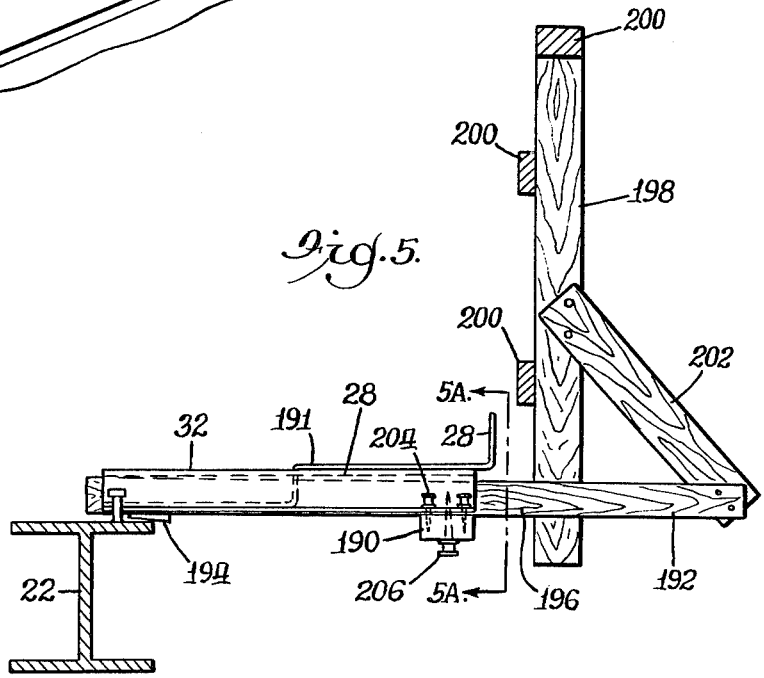
FIG. 5 is an elevation view of a protective rail for the edge construction of this invention.
Figure 5A:
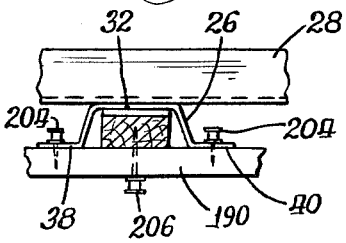
FIG. 5A is a sectional view taken along lines 5A—5A in FIG. 5.

Apparatus for protecting workers during construction is shown in FIGS. 5 and 5A. The apparatus may be wood, such as commercially available lumber, or any other suitable material. A plurality of cross bars 190 are secured to the flanges 38, 40 of support means 26, or of selected support means 26. The cross bars 190 may be secured to supports 26 before the supports are secured to the girder 22 by using double headed nails or bolts 204, or any other suitable securement means, or may be similarly secured to the supports 26 after securement to the girder 22. The cross bars 190 are preferably positioned toward the building line or designated line beneath the second horizontal portion 191 of the pans 28.

A plurality of horizontal bars 192 may be placed between the horizontal surfaces 32 of the supports 26 and the cross bars 190. A thickened portion 194 is provided on the portion of horizontal bars 192 which extends between the horizontal surface 32 and the edge girder 22. The thickened portion 194 may be a wooden block or any other suitable structure which substantially fills the space between the horizontal surface 32 and the horizontal surface 32 to resist lateral movement of the horizontal bar 192 to some extent.

A second portion 196 of the horizontal bars 192 extends beyond the building line or designated line. Vertical bars 198 are secured to second portions 196 of the horizontal bars 192 and extend upwardly. Angle bars 202 may be used for added support, if needed. At least one lateral bar 200 extends laterally between and is secured to adjacent vertical bars 198. While only one lateral bar 200 is required, several bars may be used, if desired, as seen in FIGS. 5 and 5A.

Nails 206 or any other suitable securing means may be put in the cross bars 190 and horizontal bars 192, to secure the apparatus in place. In this manner, if a worker accidentally falls towards the edge of the deck structure, the apparatus of this invention will prevent him from falling off the deck.

When construction is completed, the apparatus of FIG. 5 may be easily removed by removing the nails 206. Lateral bars 200 may be easily removed as well as the vertical bars 198, horizontal bars 192 and angle bars 202.

Objects may be prevented from falling off the deck structure by installing the protecting means 210 shown in FIG. 10, which includes a toe hold 212 removably secured to the pans 28. The toe hold 212 has an inverted V-shaped support 214 and an extended leg 216. The support 214 fits snugly on the pans 28, and the extended leg 216 extends substantially vertically from the pans 28. After the concrete is poured and work is substantially completed, the protecting means 210 may be easily removed.

Figure 3:
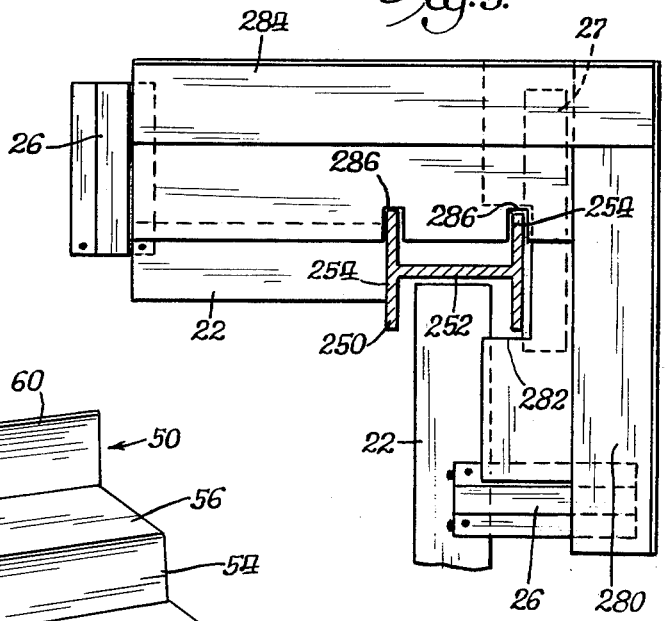
FIG. 3 is a plan view of an edge construction at the corner of a building.
Figure 6:
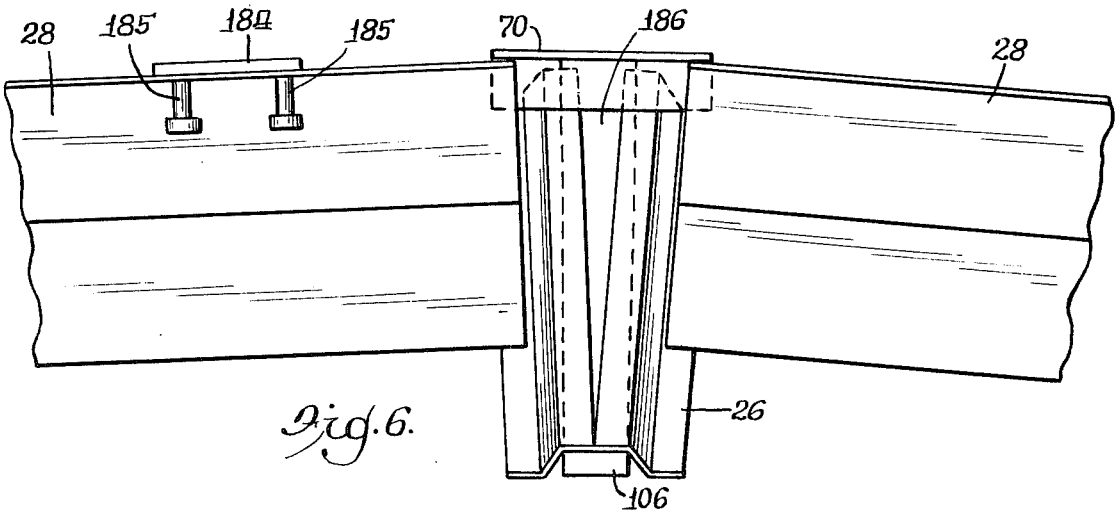
FIG. 6 is a plan view of a non-linear edge construction.

The edge constructions of this invention may be easily adapted to circumvent vertical columns in the steel frame structure, to create curved walls, and to complete the deck structure around the corners of the building, as seen in FIGS. 3 and 6.

The columns in steel frame buildings are generally similar to I-beam 250 in FIG. 3, and include a web 252 and two beam flanges 254 which extend from the web 252 at a substantially right angle. Pan 280 in FIG. 3 is provided with a notch 282 which permits the pan 280 to fit around the column 250, and pan 284 is provided with two notches 286 which permit the pan 284 to fit around the webs 254 of column 250.

The edge construction around the corner of the building is shown in FIG. 3. Notches 282 and 286 are provided in the pans 280, 284, respectively, to permit the pans to fit around column 250. The pans 280, 284 are similar to the pans 50 in FIG. 1, and overlap to form the corner of the deck structure. A corner support 27 is secured to the column 250 by any suitable means to support the pans 280, 284. Corner support 27 may be an angle, a tube, or any other suitable shape.

Some of the pans 28 may be secured at oblique angles to adjacent pans to form curved decks, as seen in FIG. 6. This may be accomplished in many ways, using many of the edge constructions of this invention, provided that there are no gaps in the deck structure through which concrete might drip. In FIG. 6, the support means 26 is separated, and a tubular support 106 is inserted in the gap 186 in the support means. A filler angle 70 fills any area between the outer edges of pans 28. Installation is similar to that described in relation to the embodiments of the invention previously described.

The dimensions of the apparatus used in the edge constructions of this invention may vary considerably for different applications. The depth of the concrete may be as much as about six inches, and the edge construction may extend as much as about 3 to about 5 feet from the edge girder. The supports are generally about 2 to about 4 inches high, and may be spaced about 5 feet apart or any other suitable distance which fits the curtain wall or other attachment to the edge construction.

The many advantages of this invention are now self-apparent. Deck structures may be constructed without the necessity of scaffolding beneath the deck including the edge construction, even though the edge construction extends beyond the edge girder. In addition, using many embodiments of the edge construction of this invention, construction of the deck structure is not interrupted when the supervisory personnel have not determined the exact building line or designated line of the structure. Modular construction permits the edge construction to be easily stacked for transportation and storage, and used to create curved exterior or interior walls. The modular construction is easily used around corners of the building. Less concrete is needed for many of the edge constructions of this invention because the depth of the concrete is reduced toward the outer edge of the deck structure, and additional lateral support is provided by the vertical side in the midsection of the pans. Also, workers may be protected from falling off the deck during construction, and objects may be prevented from falling off the deck and injuring workers below.

While in the foregoing specification this invention has been described in relation to certain preferred embodiments thereof, and many details have been set forth for purpose of illustration, it will be apparent to those skilled in the art that the invention is susceptible to additional embodiments and that certain of the details described herein can be varied considerably without departing from the basic principles of the invention.

We claim:

1. In a poured concrete building deck structure extending to the external building line or to a designated line of an internal opening wherein the deck structure has a form deck supported by structural girders with edge girders which are spaced from said building line or said designated line, an improved edge construction comprising:

said form deck terminating at said edge girders;

a plurality of spaced support means secured to the top of said edge girders and extending in cantilevered fashion beyond said edge girders towards said building line or said designated line; and a plurality of adjacent pans comprising a substantially horizontal sheet substantially filling the space between said edge girders and a predetermined distance from or at said building line or said designated line and an upstanding substantial vertical sheet capable of retaining said poured concrete and supported by at least two of said support means, said pans being in communication with and secured against movement with respect to one of said edge girders and extending beyond said edge girder toward said building line or said designated line.

2. The edge construction of claim 1 wherein at least some of said pans are secured to said edge girders.

3. The edge construction of claim 1 wherein at least some of said pans are secured to said support means.

4. The edge construction of claim 1 wherein at least some of said pans are secured to both said edge girders and said support means.

5. The edge construction of claim 1 wherein said pans extend to a predetermined distance from said building line or said designated line.

6. The edge construction of claim 1 wherein said pans extend to said building line or said designated line.

7. The edge construction of claim 1 comprising mounting means secured to said pans for mounting wall structures to said concrete building deck.

8. The edge construction of claim 7 wherein said mounting means comprises anchors for anchoring said mounting means in said concrete.

9. The edge construction of claim 1 wherein said support means comprise means for mounting wall structures to said concrete building deck.

10. The edge construction of claim 1 wherein at least some of said spaced support means comprise spaced supports having a substantially horizontal surface spaced upwardly from said edge girder by first and second substantially vertical sides, a first substantially horizontal flange adjacent said edge girder extending outwardly from said first vertical side, and a second substantially horizontal flange adjacent said edge girder extending outwardly from said second vertical side.

11. The edge construction of claim 10 wherein said substantially vertical sides are at oblique angles to permit said supports to be stacked for transportion and storage.

12. The edge construction of claim 10 wherein at least some of said supports are secured to said edge girder by stud means secured to said edge girder through each flange of said supports, whereby structural loads placed on said supports are transferred through said stud means to said edge girder.

13. The edge construction of claim 10 wherein said supports comprise a tubular support member between said first and second vertical sides.

14. The edge construction of claim 10 comprising protecting means removably secured to said supports for protecting workers during construction, said protecting means comprising:

a plurality of cross bars removably secured across the bottom of at least some of said flanges beneath said second horizontal portion of said pans;

a plurality of horizontal bars extending beneath at least some of said horizontal surfaces of said supports and extending from said edge girder, over said cross bar and beyond said building line or said designated line, said horizontal bars comprising a thickened portion extending between said horizontal surface and said edge girder, and a second portion extending beyond said line;

a plurality of vertical bars secured to said second portions of said horizontal bars and extending upwardly therefrom;

at least one lateral bar extending laterally between and secured to adjacent vertical bars; and means for securing said protecting means with respect to said supports.

15. The edge construction of claim 13 wherein said securing means comprises nail means securing said horizontal bars to said cross bars.

16. The edge construction of claim 10 wherein said pans comprise a first substantially horizontal portion resting on and extending laterally between the second horizontal flange of a first support and the first horizontal flange of an adjacent support, said first horizontal portion being secured against movement with respect to and extending from said edge girder towards one of said lines, a first substantially vertical portion extending upwardly from the outer edge of said first horizontal portion a distance to said horizontal surface of said support and extending laterally along the length of said first horizontal portion, a second substantially horizontal portion extending from said first vertical portion and extending laterally from said second horizontal flange to a point which is over or beyond the second horizontal flange of said adjacent support and beneath the second horizontal portion of an adjacent pan, said second horizontal portion extending beyond the ends of said supports, and a substantially vertical edge extending laterally along the length of said second horizontal portion and extending from said second horizontal portion a vertical distance which is sufficient to retain said poured concrete.

17. The edge construction of claim 10 wherein said plurality of spaced supports comprise a filler angle having a horizontal aspect secured to said horizontal surface of said supports and an upwardly extending aspect at or beyond the end of said support means disposed toward said building line or designated line, said filler angle extending laterally beyond said first and second vertical sides; and said pans comprising a first substantially horizontal section resting on and extending laterally between the second horizontal flange of a first support and the first horizontal flange of an adjacent support; said first horizontal section being secured against movement with respect to and extending from said edge girder towards one of said lines and a first substantially vertical section extending upwardly from the outer edge of said first horizontal section a distance to said horizontal surface of said support and extending laterally along the length of said first horizontal portion, a second horizontal section extending from said first vertical section laterally along the length of said first horizontal section and over a portion of said adjacent filler angles, and a substantially vertical edge extending laterally along the length of said second horizontal section and extending upwardly from said second horizontal section a vertical distance adjacent said upwardly extending aspect of said filler angle sufficient to retain said poured concrete.

18. The edge construction of claim 10 wherein said pans comprise a flange pan and a surface pan; said flange pan comprising a first horizontal part resting on and extending laterally between said second horizontal flange of a first support and said first horizontal flange of an adjacent support, said first horizontal part being secured against movement with respect to and extending from said edge girder towards one of said lines and a first vertical part extending upwardly from the outer edge of said first horizontal part a distance to said horizontal surface of said support and extending laterally along the length of said first horizontal part and a substantially horizontal overlap part extending from said first vertical part toward said line and extending laterally along the length of said first vertical part; said surface pan comprising a horizontal part extending laterally over said horizontal surfaces of said first support and said adjacent support, said horizontal part being adjacent said overlap part of said flange pan and extending towards said line; and a vertical part extending laterally along the length of said horizontal part and extending upwardly from said horizontal part a vertical distance which is sufficient to retain said poured concrete.

19. The edge construction of claim 18 wherein said second horizontal parts and said second vertical parts of adjacent surface pans overlap.

20. The edge construction of claim 10 wherein said pans comprise a first horizontal sheet resting on and extending laterally between the second horizontal flange of a first support and the first horizontal flange of an adjacent support, said first horizontal sheet being in communication with and secured against movement with respect to said edge girder and extending toward one of said lines; and a vertical sheet extending upwardly from the outer edge of said horizontal sheet a distance which is sufficient to retain said poured concrete, and extending laterally along the length of said horizontal sheet; and a substantially vertical joining sheet over said supports extending laterally between said vertical sheets of adjacent pans.

21. The edge construction of claim 20 comprising means for mounting wall structures on said edge construction, said mounting means extending between adjacent pans over said supports and beneath said joining sheet.

22. The edge construction of claim 1 comprising one or more shims beneath said support means for adjusting the angle of said support means with respect to a horizontal plane.

23. The edge construction of claim 1 wherein at least some of said plurality of support means comprises a plurality of spaced tubular support members having two opposing substantially vertical sides and holding members secured to said support member having flanges extending outwardly from the bottom of each said vertical sides of said support members.

24. The edge construction of claim 23 wherein at least some of said holding members have a horizontal member along the top of said tubular support member, a vertical member extending from said horizontal member along said vertical side of said tubular support member, and a flange member extending from said vertical member away from said tubular support member adjacent said edge girder, said Z-shaped members extending from said edge girder towards said building line or said designated line; and said pans comprise a substantially horizontal ledge extending laterally between said flange members of adjacent support means and extending from said edge girder toward said line; and an outer edge member extending laterally between said flange members of adjacent support means, said outer edge member extending substantially horizontally from said ledge towards said line, and extending substantially vertically a distance which is sufficient to retain said concrete; and a plurality of substantially vertical joining members over said support means extending laterally between said vertical extensions of adjacent outer edge members.

25. The edge construction of claim 1 wherein:

said pans comprise a first substantially horizontal component communicating with adjacent pans and extending from said edge girder toward said building line or said designated line;

a first substantially vertical component extending upwardly from said first horizontal component and extending laterally along the length of said first horizontal component;

a second substantially horizontal component extending from said first vertical component toward said line to a second vertical component and extending laterally along the length of said first horizontal component, said second vertical component extending from sAid second horizontal component a vertical distance which is sufficient to retain said poured concrete;

at least two orifices in said first vertical component of said pans; and said plurality of spaced support means comprising a plurality of spaced tubular supports extending from said edge girder over said first horizontal component, through said orifices and beneath said second horizontal component.

26. The edge construction of claim 25 wherein said pans overlap so that said orifices in adjacent pans are aligned, and said supports extend from said edge spandrel over said two overlapping first horizontal components, through said aligned orifices, and beneath said overlapping second horizontal components.

27. The edge construction of claim 25 wherein said tubular supports are round.

28. The edge construction of claim 25 wherein said tubular supports are rectangular.

29. The edge construction of claim 25 wherein said supports are secured to said edge girder by a stud welded to said edge girder on each side of said tubular supports, and a bridge plate secured to said studs and extending over said tubular supports, whereby structural loads placed on said tubular supports are transferred through said bridge plate and said studs to said edge girder.

30. The edge construction of claim 1 wherein said supports are secured to said edge girder by stud means.

31. The edge construction of claim 1 comprising means removably secured to said pans for preventing objects from falling off said deck structure.

32. The edge construction of claim 31 wherein said protecting means comprises a removable toe hold secured to said pans, said toe hold comprising a V-shaped support and an extended leg, said support removably fitting on said pans and said extended leg extending substantially vertically from said pans.

33. A poured concrete deck structure for a building having a plurality of metal structural girders and edge girders spaced from the external building line or a designated line of an internal opening and a plurality of vertical columns secured to said structural edge girders, said deck structure comprising:

a form deck terminating at said edge girders;

a plurality of spaced support means secured to the top of said edge girders and extending towards said line;

a plurality of adjacent pans supported by at least two of said support means for retaining said poured concrete secured to one of said edge girders and extending towards said line;

poured concrete over said form deck, said edge girders, said support means and said pans; and reinforcing wire in said concrete.

34. The deck structure of claim 33 wherein each of said pans which span across one of said vertical columns comprises at least one notch for said column, said pans being spaced along said edge girder so that said notch fits around said vertical column.

35. The deck structure of claim 33 comprising a corner support secured to said vertical column located at a corner of said building, said corner support supporting the pans which form said edge construction of said deck structure at said corner.

36. The deck structure of claim 35 wherein said column comprises an I-beam having a web and two beam flanges secured to said web at a right angle to said web;

said corner of said deck structure comprises a first pan extending along one of said beam flanges, said first pan having a first notch into which said flange fits; and a second pan extending along said web, said second pan having second and third notches into which said beam flanges fit.

37. The deck structure of claim 33 wherein certain of said pans are at oblique angles to adjacent pans.

38. The deck structure of claim 33 comprising means secured to said pans for mounting wall structures on said pans.

39. A method of installing an edge construction for a poured concrete building deck structure extending to the external building line or to a designated line of an internal opening, said deck structure having a form deck supported by structural girders, with edge girders which are spaced from said building line or said designated line comprising the steps of:

terminating said form deck at said edge girders, securing a plurality of spaced support means to the top of said edge girders and extending toward said line;

supporting a plurality of pans on said support means substantially filling the space between said edge girders and a desired distance from or to said line, said pans having a vertical sheet of sufficient height to retain poured concrete to a desired depth; and securing said pans against movement with respect to said edge girders.

40. The method of claim 39 wherein said pans are secured to said support means.

41. The method of claim 39 wherein said pans are secured to said edge girders.

42. The method of claim 39 wherein said pans are secured a predetermined distance from said building line or said designated line.

43. The method of claim 39 wherein said pans are secured to said edge girders at said building line or said designated line.

44. The method of claim 39 comprising the step of securing wall mounting structures on said pans.

45. The method of claim 39 comprising the step of supporting said pans by inserting said supports through orifices in said pans.

46. The method of claim 45 comprising the step of overlapping the ends of adjacent supports.

47. The method of claim 39 wherein said supports comprise a flange on each side of said supports, said method comprising the step of supporting said pans by placing said pans on said flanges.

48. The method of claim 39 comprising the step of securing said supports to said edge girder by stud means.

49. The method of claim 39 comprising the step of preventing objects from sliding over said deck when concrete is poured in said deck by securing a removable toe hold to the top of said edge.

50. The method of claim 39 comprising the step of protecting workers during construction by removably securing a lateral bar around said edge construction.

51. The method of claim 39 comprising the step of inserting one or more shims beneath said supports for adjusting the angle of said support means with respect to a horizontal plane.

* * * * *